US011232739B2

(12) United States Patent
Kang

(10) Patent No.: US 11,232,739 B2
(45) Date of Patent: Jan. 25, 2022

(54) ELECTRONIC DEVICE, COLOR ADJUSTMENT METHOD, AND COMPUTER-READABLE RECORDING MEDIUM

(71) Applicant: SAMSUNG ELECTRONICS CO., LTD., Suwon-si (KR)

(72) Inventor: Howoong Kang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/981,002

(22) PCT Filed: Feb. 11, 2019

(86) PCT No.: PCT/KR2019/001620
§ 371 (c)(1),
(2) Date: Sep. 15, 2020

(87) PCT Pub. No.: WO2019/216527
PCT Pub. Date: Nov. 14, 2019

(65) Prior Publication Data

US 2021/0110753 A1 Apr. 15, 2021

(30) Foreign Application Priority Data

May 9, 2018 (KR) ..... 10-2018-0053304

(51) Int. Cl.
*G09G 3/20* (2006.01)

(52) U.S. Cl.
CPC ... *G09G 3/2003* (2013.01); *G09G 2320/0666* (2013.01); *G09G 2360/144* (2013.01)

(58) Field of Classification Search
CPC ..... G09G 3/2003; G09G 2320/0666; G09G 2320/0673; G09G 2360/144; G09G 2360/16; G09G 5/02
See application file for complete search history.

(56) References Cited

U.S. PATENT DOCUMENTS 7,447,379 B2 11/2008 Choe et al.
7,804,526 B2 9/2010 Lee
(Continued)

FOREIGN PATENT DOCUMENTS

EP 1 764 764 A1 3/2007
JP 3900972 B2 4/2007
(Continued)

OTHER PUBLICATIONS

International Search Report dated Jun. 11, 2019 (PCT/ISA/210) issued by the International Searching Authority for International Application No. PCT/KR2019/001620.
(Continued)

*Primary Examiner* — Robert J Michaud
(74) *Attorney, Agent, or Firm* — Sughrue Mion, PLLC

(57) ABSTRACT

An electronic device is disclosed. The electronic device of the present disclosure comprises a communication unit, and a processor for: when receiving measurement information including color coordinate values of a display through the communication unit, calculating an average adjustment value for color coordinate values of a first region among multiple regions constituting the display by using the received measurement information; if color coordinate values at a boundary between the first region and a second region adjacent to the first region are continuous, adjusting, for each pixel, an adjustment value so that an adjustment amount of color coordinate values of the first region decreases as the adjustment amount gets closer to the boundary with reference to the average adjustment value; and if color coordinate values at the boundary between the first region and the second region are discontinuous, maintaining the adjustment amount at the average adjustment value.

13 Claims, 14 Drawing Sheets

(56) References Cited

U.S. PATENT DOCUMENTS

| | | | | |
|---|---|---|---|---|
| 7,944,431 | B2 | 5/2011 | Tanaka et al. | |
| 8,300,051 | B2 * | 10/2012 | Kim | G09G 3/20 345/428 |
| 8,988,451 | B2 | 3/2015 | Han et al. | |
| 9,524,664 | B2 | 12/2016 | Furihata et al. | |
| 2005/0094892 | A1 * | 5/2005 | Choe | G06T 5/008 382/274 |
| 2012/0038660 | A1 * | 2/2012 | Han | G09G 3/2003 345/590 |

FOREIGN PATENT DOCUMENTS

| | | | |
|---|---|---|---|
| JP | 2008-51905 | A | 3/2008 |
| JP | 2008-306431 | A | 12/2008 |
| JP | 2015-152644 | A | 8/2015 |
| JP | 6021339 | B2 | 11/2016 |
| JP | 6025387 | B2 | 11/2016 |
| KR | 10-0590529 | B1 | 6/2006 |
| KR | 10-0958324 | B1 | 5/2010 |
| KR | 10-0970883 | B1 | 7/2010 |
| KR | 10-2015-0121957 | A | 10/2015 |
| KR | 10-1741638 | B1 | 5/2017 |

OTHER PUBLICATIONS

Written Opinion dated Jun. 11, 2019 (PCT/ISA/237) issued by the International Searching Authority for International Application No. PCT/KR2019/001620.

* cited by examiner

ELECTRONIC DEVICE, COLOR ADJUSTMENT METHOD, AND COMPUTER-READABLE RECORDING MEDIUM

CROSS-REFERENCE TO RELATED APPLICATIONS

This application is a National Phase Entry of PCT International Application No. PCT/KR2019/001620, filed on Feb. 11, 2019, which claims priority to Korean Patent Application No. 10-2018-0053304 filed on May 9, 2018, the contents of all of which are incorporated herein by reference in their entirety.

TECHNICAL FIELD

The disclosure relates to an electronic device, a color compensation method, and a computer-readable recording medium and more particularly relates to an electronic device capable of expressing a uniform color over the entire screen, a color compensation method, and a computer-readable recording medium.

BACKGROUND ART

A large-sized display system is a technology of expressing an image by using one large-sized display or a plurality of display devices together for advertisement, entertainment, sports, broadcasting, and the like.

For example, such a large-sized display system has been used in forms that one large-sized display displays an image, or a plurality of display devices display the same image at the same time or display different images, respectively to be combined as one entire image in exhibitions and the like.

With an increase in size of the display, a problem occurred with a stain partially occurring on the entire screen due to a difference in brightness of optical elements. In addition, if a plurality of display devices are combined as a large-sized billboard, discontinuous color occurred on a boundary between display devices.

Therefore, it is necessary to provide a technology of uniformly expressing a color over the entire screen through color compensation of only one region of the display.

DISCLOSURE

Technical Problem

The disclosure has been made according to the above-mentioned needs and an object of the disclosure is to provide an electronic device capable of uniformly expressing a color of an entire screen through color compensation of only one region of a display, a color compensation method, and a computer-readable recording medium.

Technical Solution

In accordance with an aspect of the disclosure, there is provided an electronic device including a communicator, and a processor configured to, based on measurement information including color coordinate values of a display being received via the communicator, calculate an average compensation value of color coordinate values of a first region among a plurality of regions forming the display using the received measurement information, and based on color coordinate values on a boundary between the first region and a second region adjacent to the first region being continuous, adjust a compensation value for each pixel so that a compensation amount of the color coordinate value of the first region decreases towards the boundary from the average compensation value, and based on color coordinate values on a boundary between the first region and the second region being discontinuous, maintain the compensation amount as the average compensation value.

The processor may be configured to, based on color coordinate values on the boundary between the first region and the second region being continuous, identify a size of a region, in which the compensation amount decreases, based on a difference between an average compensation value of the first region and an average compensation value of the second region.

The first region may be a region in which a difference between an average value of color coordinate values of pixels included in each region of the plurality of regions divided from the display and a target color coordinate value is equal to or greater than a predetermined value.

The first region may be a region identified using pixels in which a difference between a color coordinate value and a target color coordinate value is a predetermined value, among the pixels of the display as boundaries.

The processor may be configured to, based on color coordinate values on a boundary of the first region being continuous and a difference between a color coordinate value on a first boundary of the first region and a color coordinate value of a second boundary of the first region is equal to or greater than a predetermined value, readjust the adjusted compensation amount so that a difference between the color coordinate value on the first boundary and the color coordinate value of the second boundary decreases.

The measurement information may include a color coordinate value for each brightness of the display, and the processor may be configured to adjust the compensation value of the first region for each brightness for each pixel.

The processor may be configured to adjust the compensation value of the first region by further considering external environment information of the display.

The external environment information may include at least one of a position, brightness, and a movement path of an external light source which emits light to the display.

The display may be a display included in the electronic device, and the processor may be configured to control the display to display a content image based on the adjusted color coordinate value.

The display may be included in an external display device separate from the electronic device, and the processor may be configured to transmit the adjusted compensation value to the external display device via the communicator.

In accordance with an aspect of the disclosure, there is provided a color coordinate compensation method of a display, the method including receiving measurement information including color coordinate values of a display, calculating an average compensation value of color coordinate values of a first region among a plurality of regions forming the display using the received measurement information, and based on color coordinate values on a boundary between the first region and a second region adjacent to the first region being continuous, adjusting a compensation value for each pixel so that a compensation amount of the color coordinate value of the first region decreases towards the boundary from the average compensation value, in which the adjusting includes, based on color coordinate values on a boundary between the first region and the second region being discontinuous, maintaining the compensation amount as the average compensation value.

The adjusting may include, based on color coordinate values on the boundary between the first region and the second region being continuous, identifying a size of a region, in which the compensation amount decreases, based on a difference between an average compensation value of the first region and an average compensation value of the second region.

The method may further include dividing the display into a plurality of regions, and the first region may be a region in which a difference between an average value of color coordinate values of pixels included in each region of the plurality of divided regions and a target color coordinate value is equal to or greater than a predetermined value.

The first region may be a region identified using pixels in which a difference between a color coordinate value and a target color coordinate value is a predetermined value, among the pixels of the display as boundaries.

The method may include, based on color coordinate values on a boundary of the first region being continuous and a difference between a color coordinate value on a first boundary of the first region and a color coordinate value of a second boundary of the first region is equal to or greater than a predetermined value, readjusting the adjusted compensation amount so that a difference between the color coordinate value on the first boundary and the color coordinate value of the second boundary decreases.

The measurement information may include a color coordinate value for each brightness of the display, and and the processor may be configured to adjust the compensation value of the first region for each brightness for each pixel.

The processor may be configured to adjust the compensation value of the first region by further considering external environment information of the display.

The external environment information may include at least one of a position, brightness, and a movement path of an external light source which emits light to the display.

The display may be a display included in the electronic device, and the processor may be configured to control the display to display a content image based on the adjusted color coordinate value.

In accordance with an aspect of the disclosure, there is provided a computer-readable recording medium including a program for executing a color coordinate compensation method of a display, the color coordinate compensation method including receiving measurement information including color coordinate values of a display, calculating an average compensation value of color coordinate values of a first region among a plurality of regions forming the display using the received measurement information, and based on color coordinate values on a boundary between the first region and a second region adjacent to the first region being continuous, adjusting a compensation value for each pixel so that a compensation amount of the color coordinate value of the first region decreases towards the boundary from the average compensation value, in which the adjusting comprises, based on color coordinate values on a boundary between the first region and the second region being discontinuous, maintaining the compensation amount as the average compensation value.

DETAILED DESCRIPTION OF EXEMPLARY EMBODIMENTS

Figure 1:
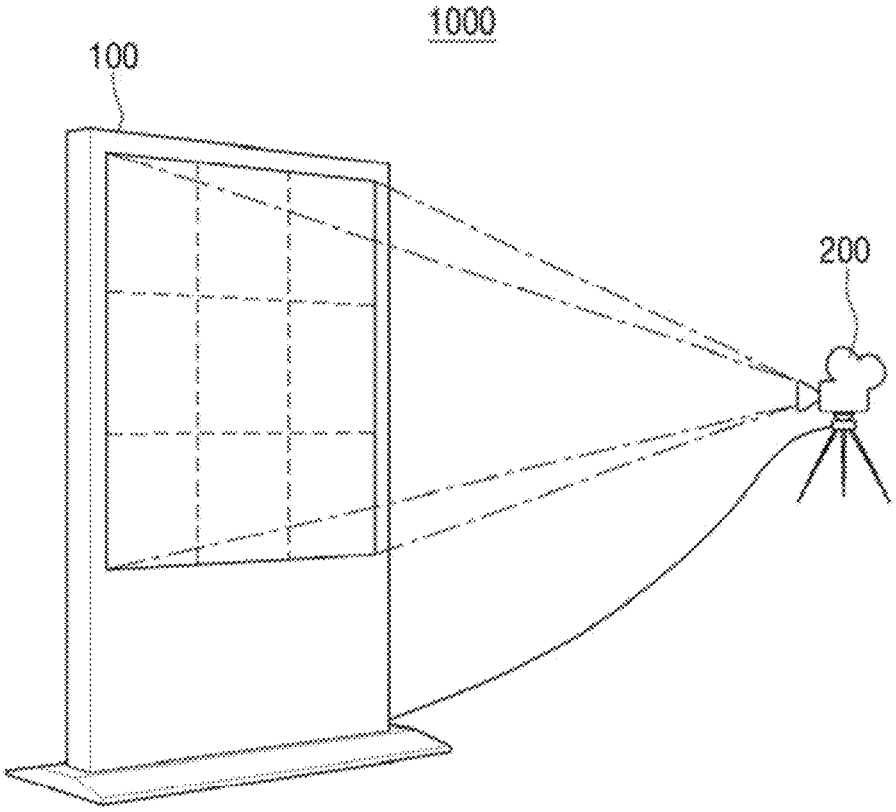
FIG. 1 is a view schematically illustrating a color coordinate compensation system of a display according to an embodiment.

The disclosure will be described in detail after briefly explaining the terms used in the specification.

The terms used in embodiments of the disclosure have been selected as widely used general terms as possible in consideration of functions in the disclosure, but these may vary in accordance with the intention of those skilled in the art, the precedent, the emergence of new technologies and the like. In addition, in a certain case, there is also a term arbitrarily selected by the applicant, in which case the meaning will be described in detail in the description of the disclosure. Therefore, the terms used in the disclosure should be defined based on the meanings of the terms themselves and the contents throughout the disclosure, rather than the simple names of the terms.

The embodiments of the disclosure may be variously changed and include various embodiments, and specific embodiments will be shown in the drawings and described in detail in the description. However, it should be understood that this is not to limit the scope of the specific embodiments and all modifications, equivalents, and/or alternatives included in the disclosed spirit and technical scope are included. In describing the disclosure, a detailed description of the related art is omitted when it is determined that the detailed description may unnecessarily obscure a gist of the disclosure.

The terms "first," "second," or the like may be used for describing various elements but the elements may not be limited by the terms. The terms are used only to distinguish one element from another.

Unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

A term such as "module" or a "unit" in the disclosure may perform at least one function or operation, and may be implemented as hardware, software, or a combination of hardware and software. Further, except for when each of a plurality of "modules", "units", and the like needs to be realized in an individual hardware, the components may be integrated in at least one module and be implemented in at least one processor (not shown).

Hereinafter, with reference to the accompanying drawings, embodiments of the disclosure will be described in detail so that those skilled in the art can easily make and use the embodiments in the technical field of the disclosure. But, the disclosure may be implemented in various different forms and is not limited to the embodiments described herein. In addition, in the drawings, the parts not relating to the description are omitted for clearly describing the disclosure, and the same reference numerals are used for the same parts throughout the specification.

Hereinafter, the disclosure will be described in detail with reference to the drawings.

FIG. 1 is a view schematically illustrating a color coordinate compensation system of a display according to an embodiment.

Referring to FIG. 1, a color coordinate compensation system 1000 of a display includes an electronic device 100 and a measurement device 200.

The electronic device 100 may include a display. The electronic device 100 may adjust a gamma curve of the display. Specifically, the adjustment of the gamma curve may imply adjustment of color coordinates for each brightness of a display screen. The color coordinates may be in various domains such as RGB, YUV, HSV, CIE, and Lab.

The measurement device 200 may measure a screen displayed by the display. Specifically, the measurement device 200 may measure a screen for each brightness displayed by the display. The measurement of a screen for each brightness displayed by the display may imply that the measurement device measures color coordinates of a screen displayed with first brightness and a screen displayed with second brightness. For example, when the display displays a screen with the first brightness (e.g., white screen), the measurement device 200 may measure this to measure a color coordinate value when brightness of the display is the first brightness. Then, when the display displays a screen with the second brightness darker than the first brightness (e.g., gray screen), the measurement device may measure this again to measure a color coordinate value when the brightness of the display is the second brightness. As described above, the measurement device 200 may measure the screen of the display which gradually gets darker from white to black or brighter from black to white. The measurement device 200 may measure the entire region of the display or only one region thereof.

The measurement device 200 may measure a pixel value for each pixel of the display or divide the display into a plurality of regions and measure a pixel value for each divided region. The pixel value may include at least one of a brightness value and a color coordinate value of a pixel. Accordingly, if the brightness of the pixel is the same, the pixel value may be the same as the color coordinate value.

When the measurement device 200 measures the pixel value for each of the divided regions of the display, the pixel value herein may include at least one of an average brightness value and an average color coordinate value of pixel groups included in the divided region. The pixel group may refer to each of a plurality of fine regions divided from the display and one fine region may be formed of a plurality of pixels. A region to be compensated among a plurality of regions forming the display may include a plurality of pixel groups.

The measurement device 200 may be an illuminance measurement device including a sensor for performing measurement operations of the brightness value and the color coordinate of the display as described above.

In another embodiment, the measurement device 200 may be a camera for capturing a screen displayed by the display. The measurement device 200 may include an image sensor and a lens and perform the measurement using an image obtained by capturing a screen displayed by the display.

The electronic device 100 may compensate the pixel value of the display by receiving measurement information from the measurement device 200. Specifically, the electronic device 100 may compensate the brightness value and the color coordinate value for each pixel of the display based on the measurement information.

For this, the electronic device 100 may calculate a compensation value of one region of a display screen using the received measurement information.

When the measurement device 200 transmits an image obtained by capturing the screen of the display, the electronic device 200 may receive the image or measurement information of the image. In this case, the electronic device 100 may first perform an operation of matching a specific position of the received image to a position of a pixel of the display. For example, the electronic device 100 may detect an edge existing in the received image and perform coordinate matching with the display based on the detected edge.

The electronic device 100 may calculate and adjust a compensation value of the pixel value forming one region of the display based on the pixel value on the boundary of the plurality of regions forming the display. The specific methods for calculation and adjustment of the compensation value will be described below with reference to FIGS. 5 and 6.

FIG. 1 illustrates that the electronic device 100 includes the display and the gamma curve of the display is adjusted based on the measurement result received from the measurement device 200, but the electronic device 100 may be an element separate from the display in the implementation. As described above, the gamma curve adjusting operation performed by the electronic device 100 may also be performed by the measurement device 200.

Figure 2:
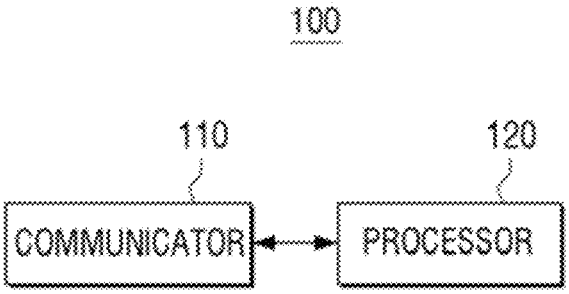
FIG. 2 is a block diagram illustrating a configuration of an electronic device according to an embodiment.

FIG. 2 is a block diagram illustrating a configuration of the electronic device according to an embodiment.

Referring to FIG. 2, the electronic device 100 according to an embodiment of the disclosure includes a communicator 110 and a processor 120.

The communicator 110 is an element for communicating with an external device. Specifically, the communicator 110 may receive measurement information including color coordinate value of the display from the measurement device. According to an embodiment, the communicator 110 may receive an image obtained by capturing the screen of the display or measurement information based on this from the measurement device.

Figure 3:
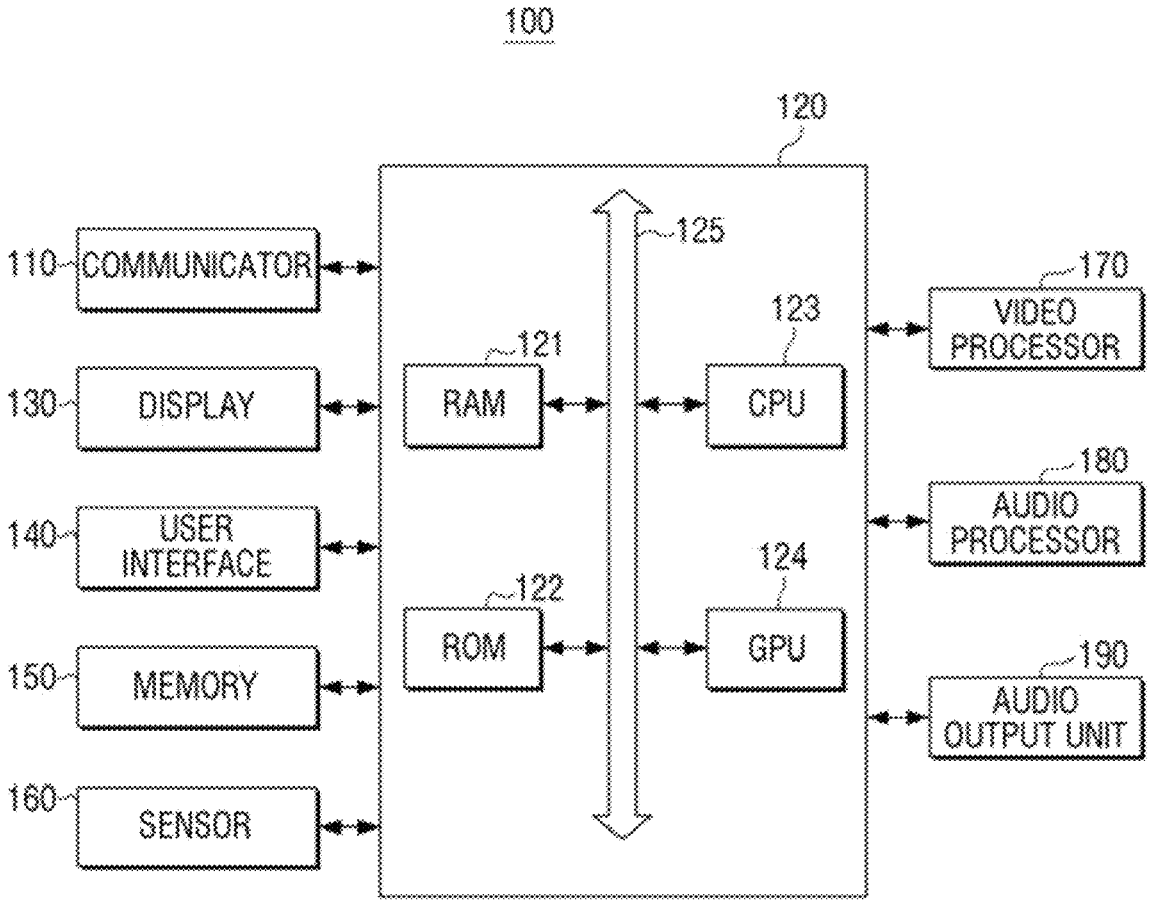
FIG. 3 is a block diagram for illustrating a specific configuration of the electronic device of FIG. 2.

When the electronic device 100 and the measurement device are the same element, an element for obtaining the measurement information may be a sensor illustrated in FIG. 3.

When the display is provided in an external display device, not in the electronic device 100, the communicator 110 may transmit a compensation value of color coordinates adjusted by the processor 120 to the external display device.

The communicator 110 may communicate with an external device by a wired or wireless method.

Specifically, the communicator 110 may be connected to an external device by the wireless method such as a wireless LAN, Bluetooth, and the like. In addition, the communicator 110 may be connected to an external device using Wi-Fi, Zigbee, or infrared light (IrDA). The communicator 110 may include a connection port for the wired method. The communicator 110 may include wired Ethernet, a high definition multimedia interface (HDMI) port, a component port, a PC port, a USB port, and the like. In addition, the communicator 110 may include a digital visual interface (DVI), a Red Green Blue (RGB) D-sub, super video (S-video).

The processor 120 may control general operations and functions of the electronic device 100.

Specifically, the processor 120 may compensate a color coordinate value of at least one region of a plurality of regions forming the display using the measurement information received via the communicator 110.

The processor 120 may calculate an average compensation value of a color coordinate value of a first region of the plurality of regions forming the display using the measurement information of the display obtained via the communicator 110. Specifically, the electronic device 100 may store a target color coordinate value of the display, receive the target color coordinate value from an external server or a user, and calculate a compensation value for compensating the color coordinate value of the display to a target pixel value. The compensation value of the display may be calculated for each pixel and compensation values different for each pixel may be applied, but an average of the compensation values is calculated for each region and the region may be collectively applied with an average compensation value, to be advantageous to a speed of calculation and a memory.

The first region is one of the plurality of regions forming the display and may be identified as a region to be compensated by specific reference. Specifically, the processor 120 may divide the display into a plurality of regions and may identify a region in which a difference between an average value of pixel values included in each region and a target pixel value is equal to or greater than a predetermined value, among the plurality of divided region, as the first region which is necessary to be compensated. The plurality of divided regions may be one pixel group including the plurality of pixels and may be one pixel. If the number of pixels included in the pixel group is small, the region may be referred to as a finely divided region. When the display is divided into the plurality of finely divided regions, the first region to be compensated may include a plurality of finely divided regions. The plurality of divided regions may have the same size or different sizes.

In another embodiment, the first region may be a region identified using pixels in which a difference between a color coordinate value and a target color coordinate value is a predetermined value, among the pixels of the display, as a boundary. In the pixels included in the first region, a difference between each pixel value and the target pixel value may be greater than the predetermined value.

The first region may be a region identified using pixel groups in which a difference between an average pixel value of the pixel group and a target pixel value is a predetermined value, among the pixel groups of the display, as a boundary. In the pixel groups included in the first region, a difference between each average pixel value and the target pixel value may be greater than the predetermined value.

In another embodiment, the first region may be a region set by a user. For example, if the electronic device 100 is a device separate from the measurement device, a user may set the first region that is necessary to be compensated in the image from the measurement device. Alternatively, the user may confirm an image displayed on the display provided in the electronic device 100 and input a region which is necessary to be compensated. Alternatively, if the user confirms the image and inputs a roughly estimated size of a stain displayed on the display to the electronic device 100, the electronic device 100 may divide the image into pieces having a size smaller than the input size of the stain. The operation of dividing the image and the operation of identifying the region which is necessary to be compensated described above will be described below in detail with reference to FIGS. 8 to 10.

The processor 120 may compensate a pixel value of one region of the display based on a pixel value of a boundary dividing a plurality of regions forming the display. Specifically, the processor 120 may adjust a compensation value by different methods according to whether the pixel values on a boundary between the first region among the plurality of regions forming the display and a second region adjacent to the first region are continuous.

Figure 4:
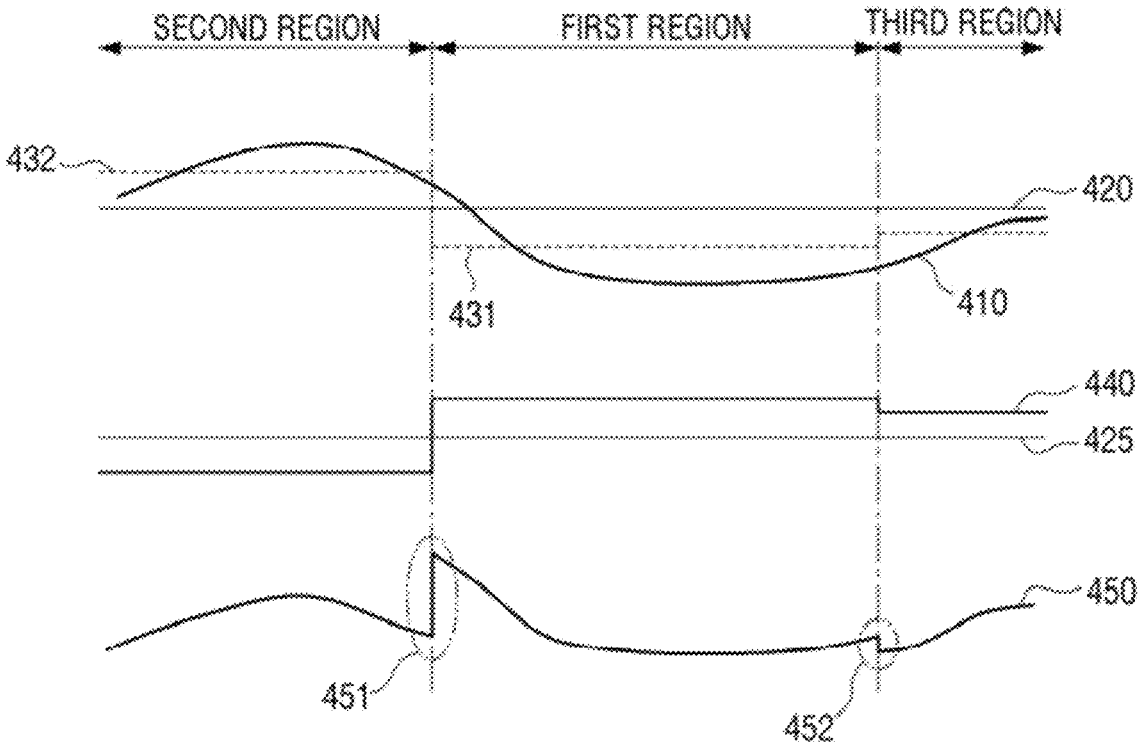
FIG. 4 is a view for illustrating the related art of color coordinate compensation of the display.

When brightness values or color coordinate values of pixels on the boundary between the first region and the second region are continuous, the processor 120 may adjust the compensation value for each pixel so that a compensation amount of color coordinates of the pixels of the first region decreases towards a boundary from an average compensation value. This is for solving a problem occurring when compensating the pixel value using the average compensation value for each region, as illustrated in FIG. 4, and the detailed compensation value adjustment operation will be described below with reference to FIG. 5.

When the brightness values or the color coordinate values of the pixels on the boundary between the first region and the second region are continuous, the processor 120 may identify a size of a region, in which the compensation amount decreases, based on a difference between the average compensation value of the first region and an average compensation value of the second region.

Specifically, if a difference between the average compensation value of the first region and the average compensation value of the second region is great, the processor 120 may adjust the compensation value to have a large size of the region in which the compensation amount decreases. On the other hand, if a difference between the average compensation value of the first region and the average compensation value of the second region is small, the processor 120 may adjust the compensation value to have a small size of the region in which the compensation amount decreases. As described above, the difference in compensation value between the adjacent regions may be reduced by making a slope or curvature of the compensation amount gentle, as the difference in compensation value between the adjacent regions is great.

When the brightness values or the color coordinate values of the pixels on the boundary between the first region and the second region are discontinuous, the processor 120 may maintain the compensation amount of the color coordinates of the pixels of the first region as the average compensation value. This will be described below in detail with reference to FIG. 6. This is for setting the color coordinate values on the boundary surface to match with each other after the compensation, when the color coordinate values on the boundary are discontinuous.

When the color coordinate values on the boundary of the first region are continuous and the difference between the color coordinate value on a first boundary of the first region and the color coordinate value on a second boundary of the first region is equal to or greater than a predetermined value, the processor 120 may readjust the adjusted compensation amount to reduce the difference between the color coordinate value on the first boundary and the color coordinate value on the second boundary. This will be described below in detail with reference to FIG. 5.

The processor 120 may repeat at least one of the operation of identifying the region to be compensated among the plurality of regions of the display and the operation of calculating and adjusting the average value of the color coordinate value twice or more. By doing so, it is possible to more uniformly express a color over the entire display screen.

The measurement information received via the communicator 110 may include a color coordinate value for each brightness of the display. Accordingly, the processor 120 may adjust the compensation value of the color coordinate value of the first region which is one region of the display for each brightness of the display, for each pixel. The embodiment of calculating and storing the compensation value for each brightness will be described below in detail with reference to FIG. 7.

The processor 120 may adjust the compensation value of the first region by further considering external environment information of the display. The external environment information of the display may include at least one of a position, brightness, and a movement path of an external light source which emits light to the display.

Specifically, since the measurement value of the display varies in accordance with a position, brightness, and the like of indoor light or sunlight emitted to the surface of the display, the processor 120 may adjust the compensation value of the pixel value of the display by considering the information such as the position, the brightness, and the like of a fluorescent light and sunlight emitted to the surface of the display. Thus, it is possible to more uniformly express a color over the entire surface display screen.

Meanwhile, the fluorescent light may be fixed in a room with a high probability, but the position of the sunlight moves in accordance with time, seasons, and weather, and the movement speed thereof also changes. Accordingly, information regarding seasons, weather, and the like may be received from an external server on the Internet via the communicator 110 and the processor 120 may adjust the compensation value of the pixel value of the display based on the received information regarding time, seasons, weather, and the like.

As described above, it is possible to uniformly express a color over the entire screen more efficiently through the color coordinate compensation of only one region of the display.

FIG. 3 is a block diagram for illustrating a specific configuration of the electronic device of FIG. 2.

Referring to FIG. 3, the electronic device 100 may include the communicator 110, the processor 120, a display 130, a user interface 140, a memory 150, a sensor 160, a video processor 170, an audio processor 180, and an audio output unit 190.

Some operations of the communicator 110 and the processor 120 are the same as in the configuration of FIG. 2, and therefore the overlapped description will not be repeated.

The processor 120 may include a RAM 121, a ROM 122, a CPU 123, a graphics processing unit (GPU) 124, and a bus 125. The RAM 121, the ROM 122, the CPU 123, and the graphics processing unit (GPU) 124 are connected to each other via the bus 125.

The CPU 123 may execute the booting using the 0/S stored in the memory 150 by accessing the memory 150. The CPU 123 may execute various operations using various programs, contents, data, and the like stored in the memory 150.

The ROM 122 may store a set of instructions for system booting. If a turn-on instruction is input to supply power, the CPU 123 copies the 0/S stored in the memory 150 to the RAM 121 and boots the system up by executing the 0/S according to the instruction stored in the ROM 122. If the booting is completed, the CPU 123 copies various programs stored in the memory 150 to the RAM 121 and executes various operations by executing the programs copied to the RAM 121.

When the booting of the electronic device 100 is completed, the GPU 124 may display a UI on the display 130. Specifically, the GPU 124 may generate a screen including various objects such as icons, images, texts, and the like by using an operating unit (not shown) and a rendering unit (not shown). The operating unit may calculate attribute values such as a coordinate value of each object to be displayed, a shape, a size, a color and the like thereof according to the layout of the screen. The rendering unit may generate screens having various layouts including objects based on the attribute values calculated by the operating unit. The screen (or user interface window) generated in the rendering unit may be provided to the display 130 and displayed in a main display region and a sub-display region.

Hereinabove, it is described that the processor 120 includes only one CPU 123 but the processor 120 may include a plurality of CPUs (or DSPs, SoC, and the like) in the implementation.

The display 130 is an element for displaying data. Specifically, the display 130 may be implemented as various types of displays such as a liquid crystal display (LCD), an organic light emitting diodes (OLED) display, a plasma display panel (PDP), and the like. The display 130 may also include a driving circuit or a backlight unit which may be implemented in a form of a-si TFT, a low temperature poly silicon (LTPS) TFT, or an organic TFT (OTFT). In addition, the display 130 may be implemented as a flexible display.

In accordance with various embodiments, the display 130 may not be provided in the electronic device 100.

The processor 120 may control the display 130 to display a content image based on the adjusted color coordinate value.

The user interface 140 is an element for receiving an interaction of a user such as manipulation of a user. Specifically, the user interface 140 may receive a manipulation command for setting a region of the display in which the color coordinate value is to be compensated, from the user.

The user interface 140 may include an optical receiver which receives an optical signal corresponding to a user input (e.g., touch, press, touch gesture, speech, or motion) from a remote controller, and a button formed on an arbitrary region such as a front portion, a side portion, or a rear portion of the appearance of a main body of the electronic device 100. If the display 130 is a touch screen, the display 130 may also be operated as the user interface 140.

The memory 150 may store various programs and data necessary for the operations of the electronic device 100. Specifically, the memory 150 may store at least one instruction. The processor 120 may perform the operations described above by executing the instruction stored in the memory 150.

The memory 150 may store the measurement information for each brightness of the display and the compensation value adjusted for each region.

If the electronic device 100 is the same element as the measurement device, the electronic device 100 may further include the sensor 160 for measuring the screen of the display. The sensor 160 may be an illuminance sensor or an image sensor for capturing an image. The processor 120 may measure a pixel value of the display based on a value sensed by the illuminance sensor or measure a pixel value of the display using an image captured by the image sensor.

The video processor 170 is an element for processing video data included in a content received via the communicator 110 or a content stored in the memory 150. The video processor 170 may execute various image processing such as decoding, scaling, noise filtering, frame rate conversion, or resolution conversion regarding the video data.

The audio processor 180 is an element for processing audio data included in the content received via the communicator 110 or the content stored in the memory 150. The audio processor 180 may execute various processing such as decoding, amplification, or noise filtering of the audio data.

When a reproduction application for a multi-media content is executed, the processor 120 may operate the video processor 170 and the audio processor 180 to reproduce the corresponding content. The display 130 may display an image frame generated by the video processor 170 on at least one region of a main display region and a sub-display region.

The audio output unit 190 may output audio data generated by the audio processor 180. The audio output unit 190 may be an element which converts a voice signal into a sound and output the sound, such as a speaker provided in the electronic device 100 or may be a port type providing a voice signal to an external speaker.

In addition, although not illustrated in FIG. 3, in accordance with the embodiment, the electronic device 100 may further include a USB port for connection of a USB connector, various external input ports such as an HDMI port, a headset, a mouse, a LAN, and the like for connection with various external terminals, and a DMB chip for receiving and processing a digital multimedia broadcasting (DMB) signal.

FIG. 4 is a view for illustrating the related art of color coordinate compensation of the display.

As illustrated in FIG. 4, the color may be differently expressed on the entire display screen due to the difference in color coordinate value 410 of the display.

As illustrated in FIG. 4 for convenience of description, assuming that the region forming the display is divided into a first region, a second region adjacent to the first region, and a third region adjacent to the other side of the first region, the electronic device may calculate an average value of color coordinates of each region of the display through the measurement. For example, the electronic device may calculate an average color coordinate value 431 of the first region, an average color coordinate value 432 of the second region, and an average color coordinate value 433 of the third region for each region.

Then, the electronic device may calculate an average compensation value 440 of each region using the average color coordinate values 431, 432, and 433 of the regions and a target color coordinate value 420. A compensation amount of the average compensation value 440 of each region may be identified based on a compensation zero line 425. The compensation zero line 425 herein may be a line representing that the compensation amount is zero. The compensation amount has been used as a term representing only a size without any direction.

In the related art, the compensation was performed to have a compensated color coordinate value 450, by collectively applying the average compensation value 440 of each region to the color coordinate value 410 of the display. However, according to the compensated color coordinate value 450 derived based on the method of the related art, discontinuity of the color coordinate values occurred on boundaries 451 and 452 of the regions, because the same average compensation value was applied for each region. Accordingly, the discontinuity of the color rather became conspicuous after the compensation.

Figure 5:
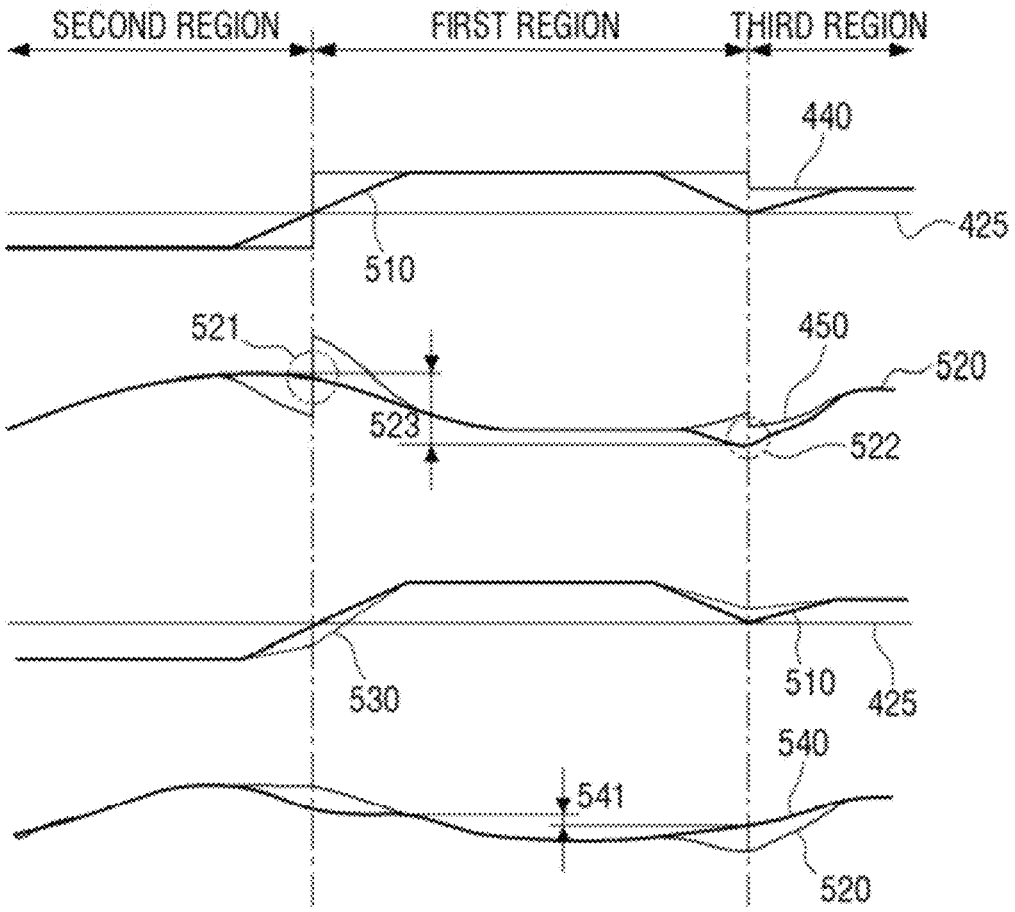
FIG. 5 is a view for illustrating a color coordinate compensation method, when color coordinate values are continuous according to an embodiment.

In order to solve this problem, as illustrated in FIG. 5, the electronic device according to an embodiment of the disclosure may adjust the compensation value so that the average compensation value is not applied on the boundaries of the regions divided from the display. Specifically, FIG. 5 is a view for illustrating a color coordinate compensation method, when color coordinate values are continuous according to an embodiment.

Referring to FIG. 5, the electronic device may correct the color coordinate compensation value 440 so that the compensation amount becomes zero on the boundaries of the regions. Specifically, the electronic device may adjust the compensation value of the first region so that the compensation value gets closer to the compensation zero line 425 towards the boundary of the first region and the second region from the average compensation value. In other words, the electronic device may adjust the compensation value of the first region so that the compensation amount is gradually decreased from the average compensation value towards the boundary of the regions. Such a compensation operation may also be performed in the second and third regions.

When an adjusted compensation value 510 obtained through the adjustment operation is applied to the color coordinate value 410 of FIG. 4, a color coordinate value 520 compensated to the adjusted compensation value 510 may be obtained. When comparing this with the compensated color coordinate value 450 of FIG. 4, it is possible to confirm that the discontinuity occurred on the boundaries 421 and 522 of the regions is disappeared.

When the compensation value is adjusted according to the method described above, the discontinuity of the color coordinate values on the boundaries between the regions may be solved. However, if the difference in color coordinate values occurs on the boundaries of the regions, the difference in color in the regions may not be sufficiently solved.

Specifically, as illustrated in FIG. 5, according to the color coordinate value 520 compensated to the adjusted compensation value, a difference 523 in color may occur in the first region due to a difference between a color coordinate value on a boundary 521 between the first region and the second region and a color coordinate value on a boundary 522 between the first region and the third region.

In order to solve this, the electronic device may readjust the adjusted compensation value 510 of the color coordinate of the region. Specifically, the electronic device may adjust the compensation value to reduce a difference value between the color coordinates of each region while continuously maintaining the compensation value on the boundary. For example, as illustrated in FIG. 5, the compensation value on the boundary between the first region and the second region may be adjusted to have a negative value since the color coordinate value on the boundary between the first region and the second region is higher than the target color coordinate value, and the compensation value on the boundary between the first region and the third region may be adjusted to have a positive value since the color coordinate value on the boundary between the first region and the third region is lower than the target color coordinate value.

When a readjusted compensation value 530 obtained through such a readjusting operation is applied to the color coordinate value 410 of FIG. 4, a color coordinate value 540 compensated with the readjusted compensation value 530 may be obtained. By comparing this with the color coordinate value 520 compensated with the adjusted compensation value of FIG. 5, it is possible to confirm that the values on the boundaries of the regions are continuous and the difference in color in the first region is reduced (541) thereby expressing a uniform color.

Hereinabove, the description has been made regarding one dimension, for convenience of description, but the disclosure is not limited thereto, and in the implementation, the same method may be applied to, not only a horizontal direction, but also a vertical direction and two-dimensionally.

Figure 6:
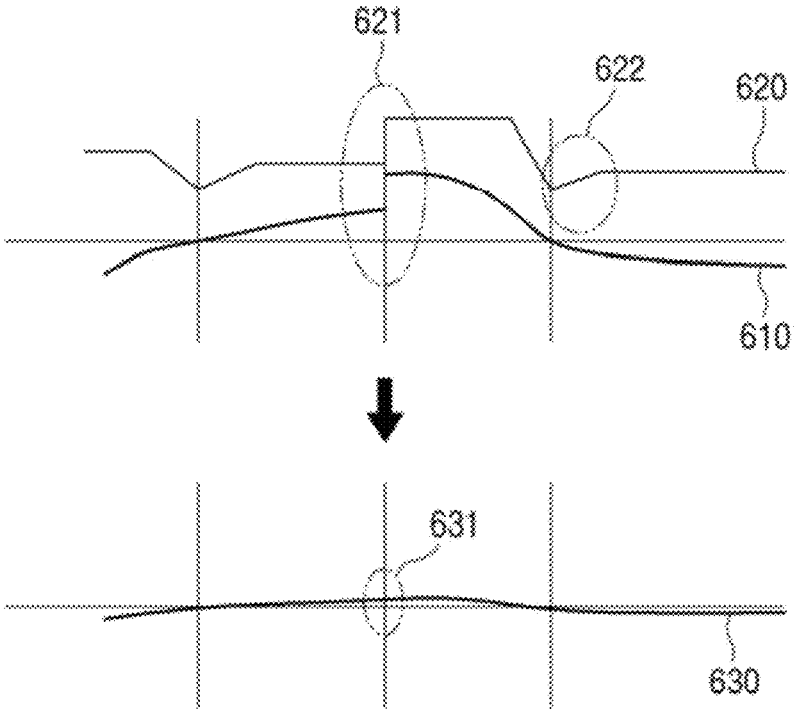
FIG. 6 is a view for illustrating a color coordinate compensation method, when color coordinate values are discontinuous according to an embodiment.

FIG. 6 is a view for illustrating a color coordinate compensation method, when color coordinate values are discontinuous according to an embodiment. Specifically, when the discontinuity of the color coordinate values occurs between the plurality of regions forming one display or when the plurality of displays are connected to display one screen, the discontinuity may occur on a boundary between the displays.

Referring to FIG. 6, as a result of display measurement, a color coordinate 610 of the display may include a boundary with discontinuous color coordinate values between regions and a boundary with continuous color coordinate values.

For the boundary with the continuous color coordinate values between the regions from the color coordinate 610 of the display, a compensation value may be adjusted using the method illustrated in FIG. 5. At this time, in an adjusted compensation value 620, a compensation value 622 on the boundary with the continuous color coordinate values between the regions may be adjusted to be gradually reduced from the average compensation value towards the boundary.

For the boundary with the discontinuous color coordinate values between the regions, if a compensation value is calculated to apply the same compensation amount on the boundary as in FIG. 5, the discontinuity on the boundary is maintained. Therefore, in such a case, the average compensation value of each region may be applied as it is for a compensation value 621 from the adjusted compensation value 620 on the boundary with the discontinuous color coordinate values between the regions.

As described above, when the color coordinates on the boundary between the regions are discontinuous, color coordinate value 631 of both regions on the boundary may be set to be the same or have reduced difference, according to a compensated color coordinate 630 obtained by applying the average compensation value of the region as it is.

Figure 7:
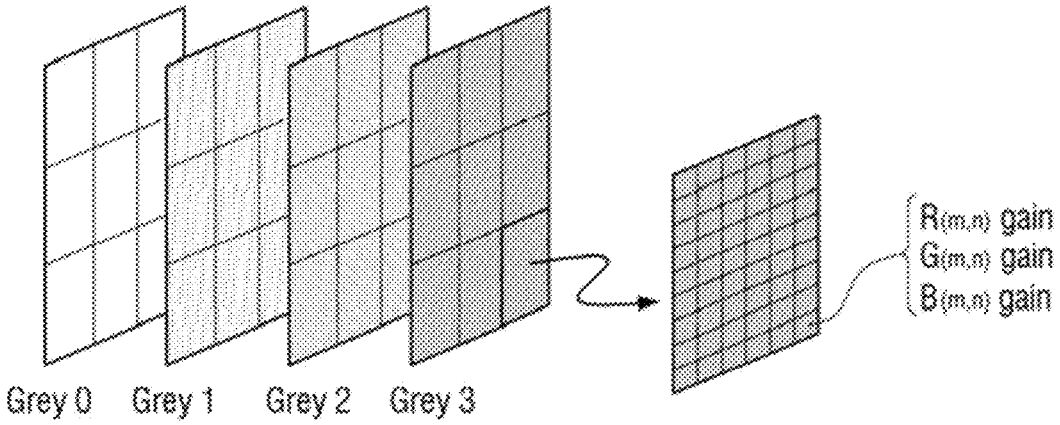
FIG. 7 is a view for illustrating a compensation value for each brightness according to an embodiment.

FIG. 7 is a view for illustrating a compensation value for each brightness according to an embodiment.

Referring to FIG. 7, the electronic device may receive measurement information for each brightness of the display. The measurement information may be divided for each of the plurality of regions forming the display and may be divided for each of the plurality of finely divided regions from each region.

For example, the display may be measured for each of four brightness such as Grey 0, Grey 1, Grey 2, and Grey 3. In the implementation, the display may be measured for each of less than four or five or more brightness. In addition, at each brightness level, the display may be divided into 3×3 divided regions. Each divided region may be divided into m×n finely divided regions. The finely divided region may include at least one pixel.

FIG. 7 illustrates RGB compensation values (gain) of the finely divided region (m,n) in the divided region (3,3) of the Grey 3, for convenience of description, and the electronic device may need 4*(3*3)*(m*n)*3 storage cells to store all of the compensation values for each brightness.

According to the disclosure, the compensation value may be adjusted for each divided region or for each finely divided region, and therefore, each compensation value may change.

Figure 8:
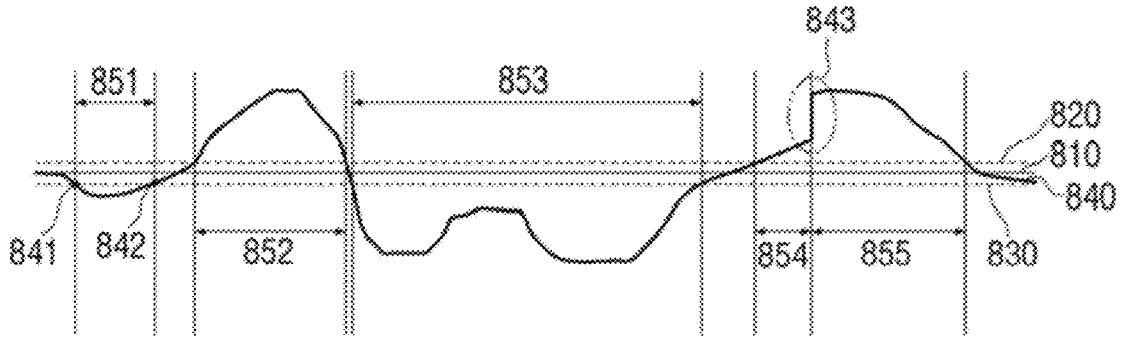
FIGS. 8 to 10 are views for illustrating embodiments of identifying a region to be compensated from a screen.
Figure 9:
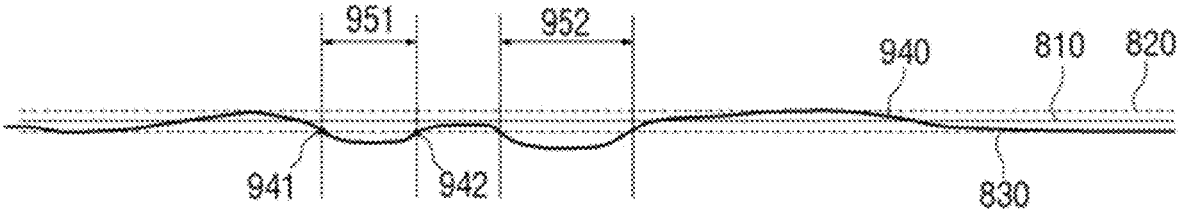
Figure 10:
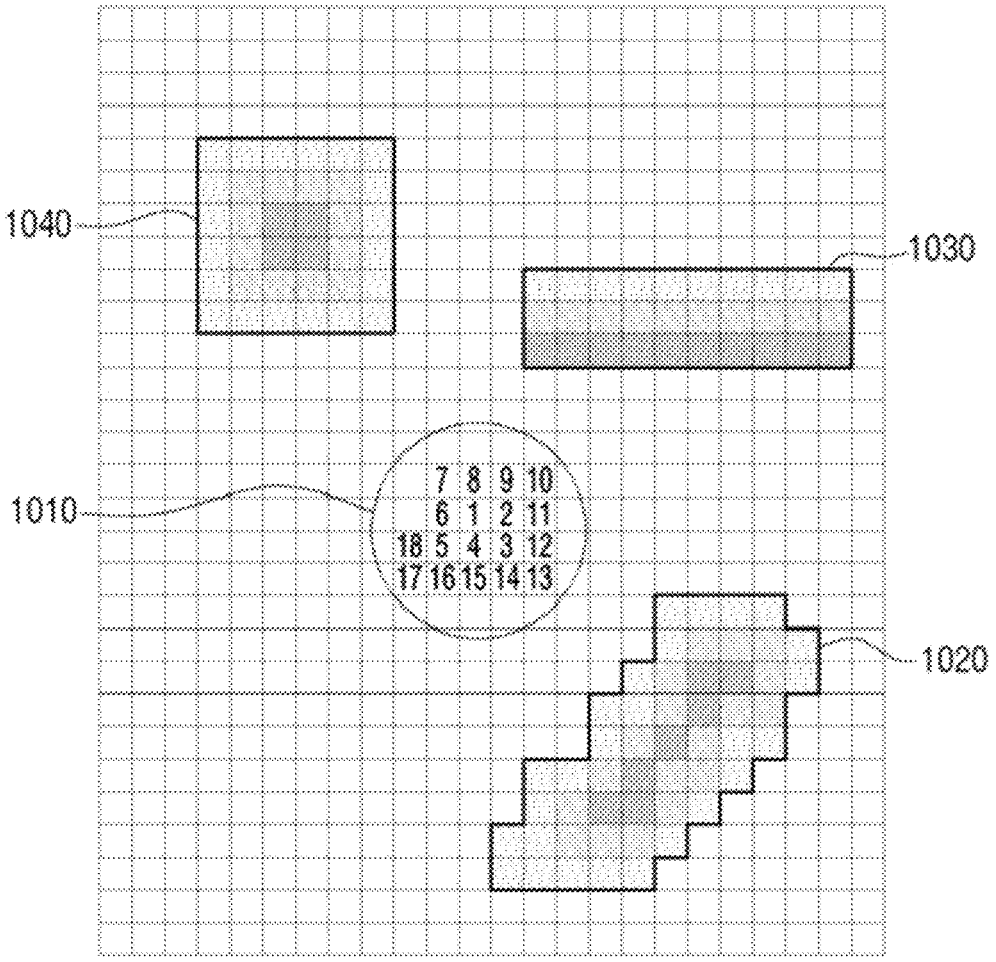

FIGS. 8 to 10 are views for illustrating embodiments of identifying a region to be compensated from a screen.

Referring to FIG. 8, the display may have a target color coordinate value 810, a maximum allowable error 820, and a minimum allowable error 830. The allowable errors 820 and 830 may be set based on the target color coordinate value 810 to the extent that a difference in color is hardly visually observed or allowable.

The electronic device may identify a region which is necessary to be compensated using a color coordinate value 840 included in the measurement information of the display. Specifically, the electronic device may identify a region so that pixels having the color coordinate value of the allowable errors 820 and 830 become a boundary.

Referring to FIG. 8, the electronic device may identify a first divided region 851 using intersections 841 and 842 intersecting with the color coordinate value 840 and the minimum allowable error 830 as start and end points, in other words, boundaries of the region. In addition, the electronic device may identify a second divided region 852 using intersections intersecting with the color coordinate value 840 and the maximum allowable error 820 as boundaries of the region. The electronic device may identify a third divided region 853 using intersections intersecting with the color coordinate value 840 and the minimum allowable error 830 as boundaries of the region.

The method for identifying the region to be compensated using the intersections of the allowable errors 820 and 830 and the color coordinate values 840 as the boundaries as described above may be applied to a section with continuous color coordinate values 840, and the electronic device may identify a region using discontinuous points as boundaries at a point where the color coordinate values 840 are discontinuous.

Specifically, the electronic device may identify a fourth divided region 854 and a fifth divided region 855 using a point where the color coordinate value exceeds the maximum allowable error 820 and a point 843 where the coordinate values are discontinuous as boundaries.

FIG. 9 illustrates a color coordinate value 940 after applying the compensation method of FIGS. 5 and 6 to each of the regions divided in FIG. 8. A portion with discontinuous color coordinate values has been disappeared and a difference between color coordinate values in each divided region has been decreased through the compensation process described above.

However, referring to FIG. 9, the color coordinate value 940 obtained by compensation may have a region exceeding the target color coordinate value 810 and the allowable errors 820 and 830. The electronic device may identify a first divided region 951 again using intersections 941 and 942 of the color coordinate value 940 obtained by the compensation and the allowable errors 820 and 830 as boundaries. The electronic device may identify a second divided region 952 using intersections of the coordinate value 940 and the allowable errors 820 and 830 as boundaries. Since the color coordinate value 940 of FIG. 9 has no discontinuous portion, the electronic device may repeatedly compensate the color coordinate value by applying the compensation method of FIG. 5 with respect to the first divided region 951 and the second divided region 952.

FIG. 10 is a view illustrating an embodiment of designating a divided region to be compensated from the entire screen of the display.

Referring to FIG. 10, the electronic device may divide the entire display into a plurality of finely divided regions 1001 and identify a divided region to be compensated based on measurement information of each finely divided region. The electronic device may identify whether color coordinate values of the finely divided regions are beyond the allowable error clockwise (or anticlockwise) from the center as in an order 1010 illustrated in FIG. 10. Specifically, the electronic device may identify whether a difference between an average value of color coordinate values of the finely divided region and a target color coordinate value is equal to or greater than a predetermined value. The electronic device may designate the finely divided region identified to be beyond the error as a group. The confirmation order 1010 may start from the center of the display.

According to the above description, the electronic device may identify regions 1020, 1030, and 1040 which are necessary to be compensated in various forms and may not perform compensation with respect to other regions. The boundaries of the region to be compensated may have continuous color coordinate values (1020, 1040), and in this case, the electronic device may adjust the compensation value using the compensation method as illustrated in FIG. 5. The boundaries of the region to be compensated may have discontinuous color coordinate values (1030), and in this case, the electronic device may adjust the compensation value using the compensation method as illustrated in FIG. 6.

Figure 11:
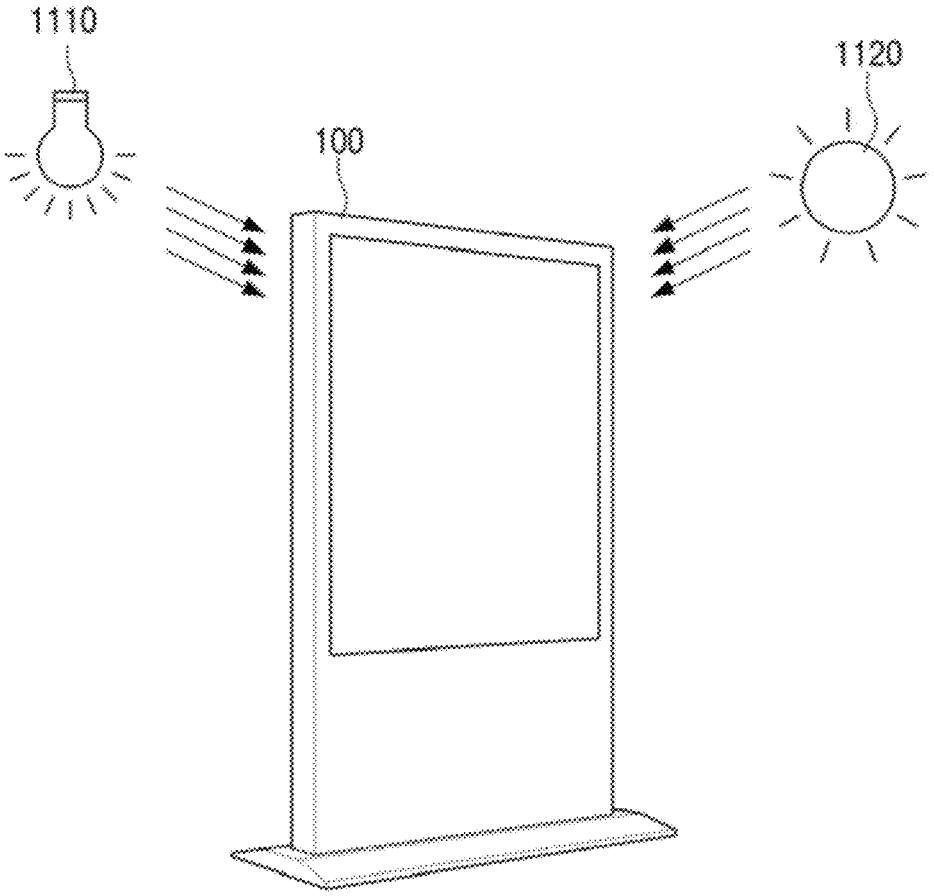
FIGS. 11 and 12 are views for illustrating embodiments of performing color coordinate compensation of the display by considering external environment information.
Figure 12:
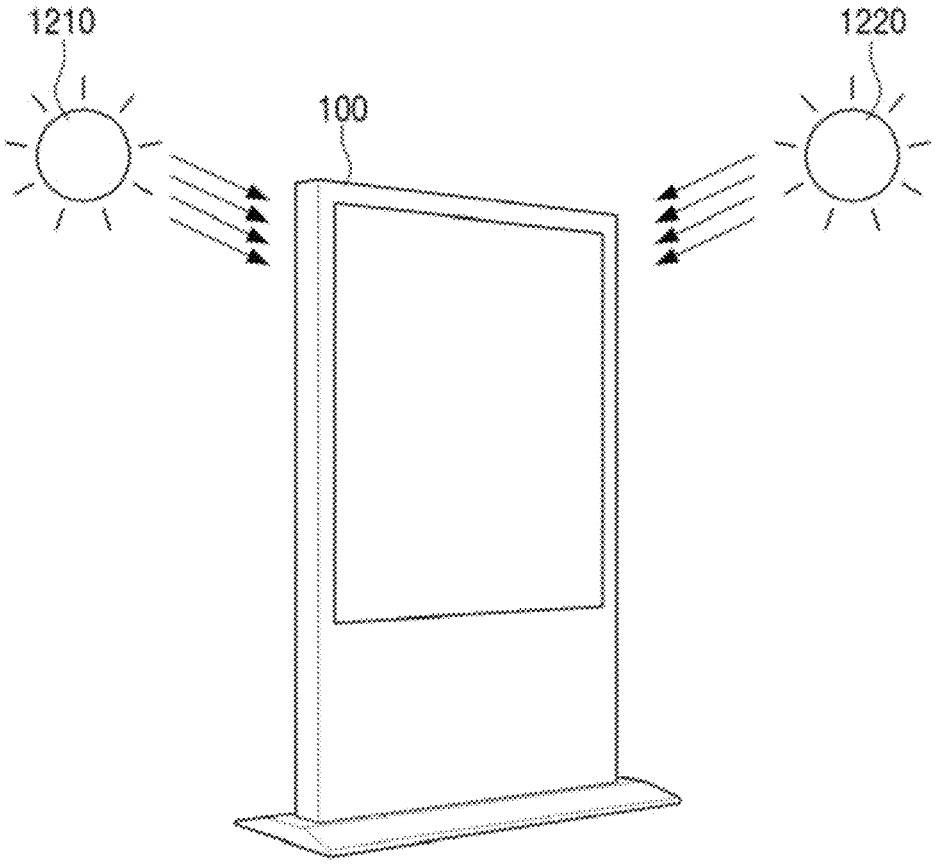

FIGS. 11 and 12 are views for illustrating embodiments of performing color coordinate compensation of the display by considering external environment information.

Referring to FIG. 11, the electronic device 100 may compensate the color coordinate of the display by further considering at least one of a position, brightness, and a movement path of an external light source which emits light to the display. For example, the external light source may include at least one of an indoor light 1110 and sunlight 1120 emitted to the display. The external light source may emit light to the entire or a part of the display.

Specifically, the electronic device may detect a position or brightness of the indoor light 1110 or the sunlight 1120 using the sensor provided therein or use information input by a user as external environment information. The electronic device may use information measured by a measurement device in a state where the entire or a part of the display is illustrated with the external light source.

As illustrated in FIG. 12, the sunlight may move over time. For example, the sunlight 1210 emits light to the display from the left side of the electronic device 100 in the morning, but the sunlight 1220 may emit light to the display from the right side of the electronic device 100 in the afternoon. The position, the movement path, and the brightness, and the like of the sunlight 1020 and 1220 may change depending on weather, seasons, time, and the like, and accordingly, the electronic device 100 may receive information of weather, seasons, and time from the external server and use this as information regarding the sunlight 1210 and 1220.

FIGS. 11 and 12 illustrate that the electronic device 100 includes the display, but in the implementation, a display device including the display may be an element separate from the electronic device for compensating the color coordinate value of the display.

Figure 13:
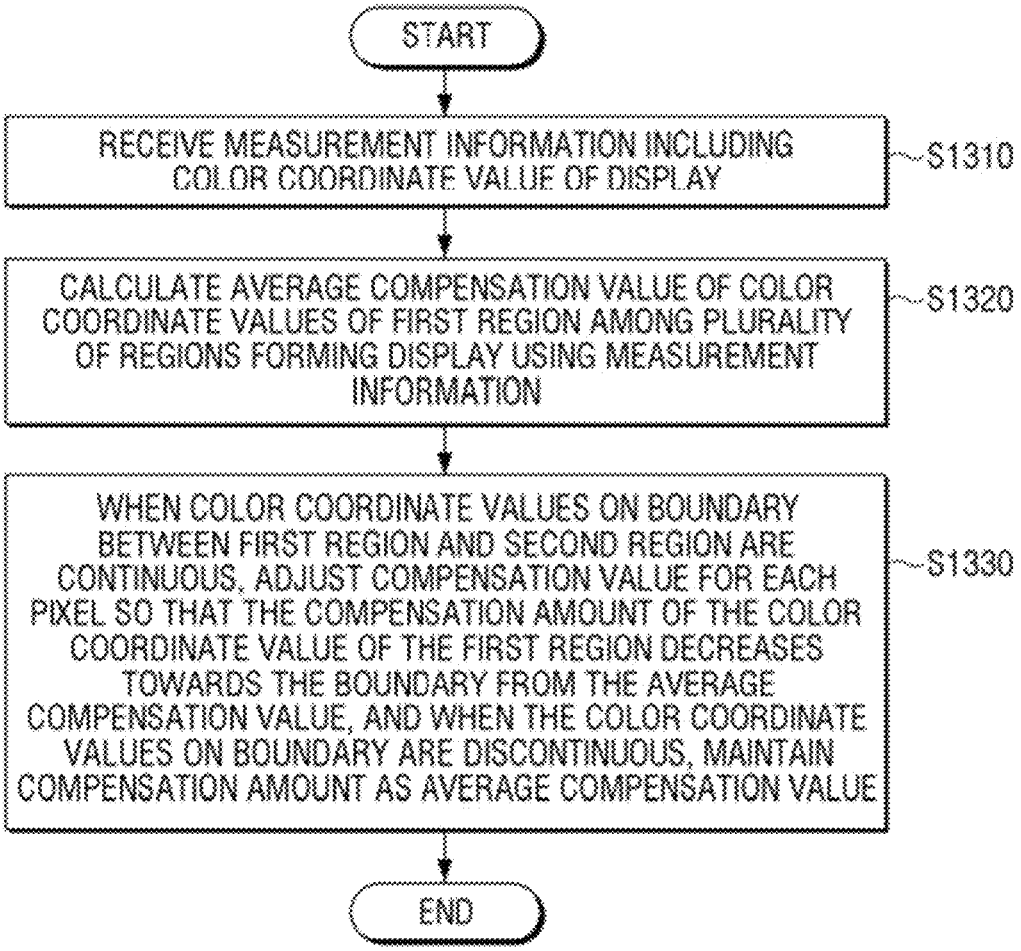
FIG. 13 is a flowchart for illustrating a color coordinate compensation method according to an embodiment.

FIG. 13 is a flowchart for illustrating a color coordinate compensation method according to an embodiment.

Referring to FIG. 13, the electronic device may receive measurement information including a color coordinate value of the display (S1310). Specifically, the electronic device may receive measurement information from the measurement device and the display described above may be included in the electronic device or may be included in a display device separate from the electronic device.

When the electronic device is the same element as the measurement device, the electronic device and the display device are separate elements, and the electronic device may measure a color coordinate value of the display provided in the external display device using the sensor.

Then, the electronic device may calculate an average compensation value of color coordinate values of a first region among a plurality of regions forming the display using the measurement information (S1320). Specifically, the electronic device may divide the display into a plurality of regions and identify a region to be compensated among the plurality of regions. The electronic device may calculate a compensation value of each of pixel included in the first region identified to be compensated and an average compensation value thereof.

Next, when the color coordinate values on the boundary between the first region and a second region adjacent thereto are continuous, the electronic device may adjust the compensation value for each pixel so that the compensation amount of the color coordinate value of the first region decreases towards the boundary from the average compensation value, and when the color coordinate values on the boundary are discontinuous, the compensation amount may be maintained as the average compensation value (S1330). When the color coordinate values on the boundary between the first region and the second region adjacent thereto are continuous, the electronic device may adjust the compensation amount to increase a size of a region, in which the compensation amount is decreased, if a difference between the average compensation value of the first region and the average compensation value of the second region is great.

Although not illustrated, when the difference between color coordinate values of right and left boundaries of the first region is equal to or greater than a predetermined value, the electronic device may readjust the compensation value to reduce the difference in color coordinate value. Hereinabove, it is described that only the color coordinate value is compensated, but in the implementation, the brightness value may also be compensated.

Figure 14:
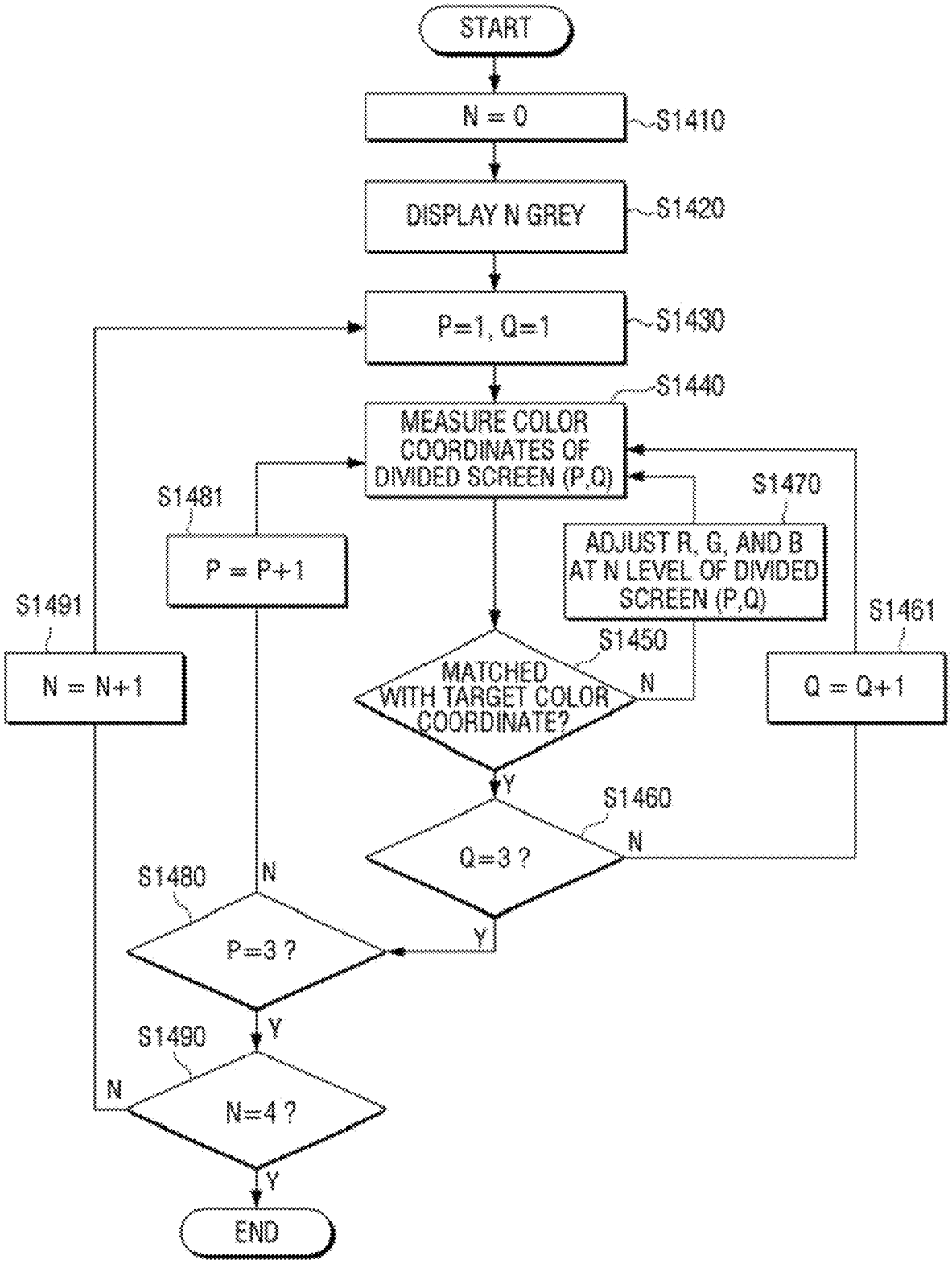
FIG. 14 is a flowchart for illustrating a gamma curve adjusting method of the display according to an embodiment.

FIG. 14 is a flowchart for illustrating a gamma curve adjusting method of the display according to an embodiment. For convenience of description, the display may be formed of 3×3 regions.

The electronic device may set a grey level (N) of the display as 0 (S1410). Then, the electronic device may control the display to display the set grey level (S1420).

The electronic device may set a row (P) and a column (Q) for designating one region among a plurality of regions forming the display as 1, respectively (S1430). Then, the electronic device may measure color coordinates of a divided screen of the set (P,Q). The measurement of the color coordinates may imply receiving measurement information of the set divided region from the measurement device.

The electronic device may identify whether the color coordinate of the divided screen matches with a target color coordinate (S1450). When the measured color coordinate does not match with the target color coordinate (S1450—N), the electronic device may adjust color coordinate value at the grey level of the set divided region, for example, R, G, B output values (S1470). The electronic device may compensate the color coordinate value of the set divided region using the color coordinate value on the boundary of the set divided region according to the embodiments of the disclosure.

After adjusting the color coordinate value, the electronic device may repeat measuring the color coordinate of the set divided region again and identifying whether the color coordinate matches with the target color coordinate.

When the measured color coordinate matches with the target color coordinate (S1450—Y), the electronic device may determine whether Q is 3 (S1460), and when Q is not 3 (S1460—N), the electronic device may convert Q into Q+1 value (S1461) and repeat the steps of measuring and compensating the color coordinate of the divided region of (P,Q). This is for measuring and compensating the color coordinate of the region which is positioned on the same column (P) as the region with the compensated color coordinate and adjacent thereto.

When Q is 3 (S1460—Y), the measurement and the compensation with respect to the regions on the first column are completed, and accordingly, the electronic device may determine whether P is 3 (S1480). When P is 3 (S1480—N), the electronic device may convert P into the P+1 value (S1481) and repeat the steps of measuring and compensating the color coordinate of the divided region (P,Q).

When P is 3 (S1480—Y), the electronic device may determine whether the grey level (N) is 4 (S1490). When the grey level (N) is not 4 (S1490—N), the electronic device may convert N into N+1 (S1491) and return to Step S1430 of setting the value of P and Q as 1. This is for measuring color coordinates of each divided region of a new grey level.

According to the embodiments described above, it is possible to uniformly express the color over the entire screen more efficiently through the color coordinate compensation of only one region of the display.

The embodiments described above may be implemented in a recording medium readable by a computer or a similar device using software, hardware, or a combination thereof. According to the implementation in terms of hardware, the embodiments of the disclosure may be implemented using at least one of Application Specific Integrated Circuits (ASICs), digital signal processors (DSPs), digital signal processing devices (DSPDs), programmable logic devices (PLDs), field programmable gate arrays (FPGAs), processors, controllers, micro-controllers, microprocessors, and electronic units for executing other functions. In some cases, the embodiments described in the specification may be implemented as the processor 120 itself. According to the implementation in terms of software, the embodiments such as procedures and functions described in this specification may be implemented as separate software modules. Each of the software modules may perform one or more functions and operations described in this specification.

The image processing method according to the embodiments of the disclosure descried above may be stored in a non-transitory computer-readable medium. Such a non-transitory readable medium may be mounted and used on various devices.

The non-transitory computer-readable medium is not a medium storing data for a short period of time such as a register, a cache, or a memory, but means a medium that semi-permanently stores data and is readable by a machine. Specifically, the programs for various methods described above may be stored and provided to the non-transitory computer-readable medium such as a CD, a DVD, a hard disk drive, a Blu-ray disc, a USB, a memory card, and a ROM.

According to an embodiment, the methods according to various embodiments disclosed in this disclosure may be provided to be included in a computer program product. The computer program product may be exchanged between a seller and a purchaser as a commercially available product. The computer program product may be distributed in the form of a machine-readable storage medium (e.g., compact disc read only memory (CD-ROM)) or distributed online through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

While preferred embodiments of the disclosure have been shown and described, the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. An electronic device comprising:

a communicator; and a processor configured to, based on measurement information including color coordinate values of a display being received via the communicator, calculate an average compensation value of color coordinate values of a first region among a plurality of regions forming the display using the received measurement information, and based on color coordinate values on a boundary between the first region and a second region adjacent to the first region being continuous, identify a size of a region, in which a compensation amount decreases, based on a difference between the average compensation value of the first region and an average compensation value of the second region, based on the identified size of the region, adjust a compensation value for each pixel so that the compensation amount of the color coordinate value of the first region decreases towards the boundary from the average compensation value of the first region, and based on the color coordinate values on the boundary between the first region and the second region being discontinuous, maintain the compensation amount as the average compensation value of the first region.

2. The device according to claim 1, wherein the first region is a region in which a difference between an average value of color coordinate values of pixels included in each region of the plurality of regions divided from the display and a target color coordinate value is equal to or greater than a predetermined value.

3. The device according to claim 1, wherein the first region is a region identified using pixels in which a difference between a color coordinate value and a target color coordinate value is a predetermined value, among the pixels of the display as boundaries.

4. The device according to claim 1, wherein the processor is configured to, based on color coordinate values on a boundary of the first region being continuous and a difference between a color coordinate value on a first boundary of the first region and a color coordinate value of a second boundary of the first region is equal to or greater than a predetermined value, readjust the adjusted compensation amount so that the difference between the color coordinate value on the first boundary and the color coordinate value of the second boundary decreases.

5. The device according to claim 1, wherein the measurement information comprises a color coordinate value for each brightness of the display, and wherein the processor is configured to adjust the compensation value of the first region for each brightness for each pixel.

6. The device according to claim 1, wherein the processor is configured to adjust the compensation value of the first region by further considering external environment information of the display.

7. The device according to claim 6, wherein the external environment information comprises at least one of a position, brightness, and a movement path of an external light source which emits light to the display.

8. The device according to claim 1, wherein the display is a display included in the electronic device, and wherein the processor is configured to control the display to display a content image based on the adjusted color coordinate value.

9. The device according to claim 1, wherein the display is included in an external display device separate from the electronic device, and wherein the processor is configured to transmit the adjusted compensation value to the external display device via the communicator.

10. A color coordinate compensation method of a display, the method comprising:

receiving measurement information including color coordinate values of a display;

calculating an average compensation value of color coordinate values of a first region among a plurality of regions forming the display using the received measurement information;

based on color coordinate values on a boundary between the first region and a second region adjacent to the first region being continuous, identifying a size of a region, in which a compensation amount decreases, based on a difference between the average compensation value of the first region and an average compensation value of the second region, based on the identified size of the region, adjusting a compensation value for each pixel so that the compensation amount of the color coordinate value of the first region decreases towards the boundary from the average compensation, value of the first region; and wherein the adjusting comprises, based on the color coordinate values on the boundary between the first region and the second region being discontinuous, maintaining the compensation amount as the average compensation value of the first region.

11. The method according to claim 10, further comprising:

dividing the display into a plurality of regions, wherein the first region is a region in which a difference between an average value of color coordinate values of pixels included in each region of the plurality of divided regions and a target color coordinate value is equal to or greater than a predetermined value.

12. The method according to claim 10, wherein the first region is a region identified using pixels in which a difference between a color coordinate value and a target color coordinate value is a predetermined value, among the pixels of the display as boundaries.

13. The method according to claim 10, further comprising:

based on color coordinate values on a boundary of the first region being continuous and a difference between a color coordinate value on a first boundary of the first region and a color coordinate value of a second boundary of the first region is equal to or greater than a predetermined value, readjusting the adjusted compensation amount so that the difference between the color coordinate value on the first boundary and the color coordinate value of the second boundary decreases.

* * * * *